United States Patent [19]

Okamoto et al.

[11] Patent Number: 4,845,524

[45] Date of Patent: Jul. 4, 1989

[54] IMAGE FORMING METHOD

[75] Inventors: Hiroshi Okamoto; Naoki Toyoshi; Kenji Tabuchi; Kaoru Takebe; Taisuke Nagao, all of Osaka, Japan

[73] Assignee: Minolta Camera Kabushiki Kaisha, Osaka, Japan

[21] Appl. No.: 201,210

[22] Filed: Jun. 2, 1988

[30] Foreign Application Priority Data

Jun. 3, 1987 [JP] Japan ..... 62-140495
Jun. 9, 1987 [JP] Japan ..... 62-144516

[51] Int. Cl.[4] ..... G03G 15/01

[52] U.S. Cl. ..... 355/239; 355/77; 355/218; 355/328; 430/42

[58] Field of Search ..... 355/3 R, 4, 77; 430/31, 430/42, 54

[56] References Cited

U.S. PATENT DOCUMENTS 4,472,047 9/1984 Stoudt ..... 355/4
4,579,443 4/1986 Abuyama et al. ..... 355/4
4,582,417 4/1986 Yagasaki et al. ..... 355/7

FOREIGN PATENT DOCUMENTS 950767 7/1974 Canada .
60-43669 3/1985 Japan .
61-256357 11/1986 Japan .

*Primary Examiner*—R. L. Moses
*Attorney, Agent, or Firm*—Burns, Doane, Swecker & Mathis

[57] ABSTRACT

The disclosure relates to a method, using an electrophotographic system, including a first process of transferring the image of an original document to a copy sheet and a second process of transferring a half-tone solid on a specified region of the image on the copy sheet transferred at the first process. Accordingly, for example, when a copy sheet is white, a black toner is used in the first image forming process, and a white toner is used in the second image forming process, a white half-tone solid of the white toner is superimposed on the black toner image. As a result, the black toner image formed on the specified region looks soft half-tone.

9 Claims, 8 Drawing Sheets

IMAGE FORMING METHOD

BACKGROUND OF THE INVENTION

1. Field of the Invention

The present invention relates to an image forming method using an electrophotographic copying system.

2. Description of the Related Art

The object of an image forming apparatus such as a copying machine is to faithfully reproduce the image of an original document on a copy sheet.

The amount of a toner which is transferred to an electrostatic latent image formed on a photoreceptor drum is not proportional to an image density beyond a certain point. Therefore, when an original document having a photograph is copied, the tone of the image of the photograph is not preferable. In other words, the photograph of the original document cannot always be copied faithfully.

Japanese Laid-Open Patent Publication No. 43669/1985 discloses an image forming apparatus in order to solve this problem. According to this method, the image of letters are copied in the document-copying mode and that of a photograph is copied in a photograph-copying mode by adjusting the electric potential on the surface of an electrostatic latent image-holding member and the amount of a light applied to the letters and the photograph. Nevertheless, a part of the image of the photograph cannot be copied faithfully. Therefore, it is necessary to provide the image forming apparatus with a specific unit to correct such a defect.

SUMMARY OF THE INVENTION

Accordingly, an essential object of the present invention is to provide an improved image forming method capable of overcoming such a disadvantage as described above.

In accomplishing the object, there is provided a method, using an electrophotographic system, comprising a first process of transferring the image of an original document to a copy sheet and a second process of transferring a half-tone solid on a specified region of the image on the copy sheet transferred at the first process.

More specifically, the method for forming an image using an electrophotographic system in accordance with the present invention includes a first step of charging a photoreceptor, a second step of exposing the surface of the charged photoreceptor to a light reflected from an image of an original document so as to form an electrostatic latent image on the photoreceptor, a third step of developing the electrostatic latent image formed on the photoreceptor using a first toner, a fourth step of transferring the first toner image formed on the photoreceptor to a copy sheet, a fifth step of re-charging the photoreceptor, a sixth step of irradiating the charged photoreceptor so as to erase an electric charge which has remained on a region except the electric charge on the specified region, a seventh step of developing the specified region of the photoreceptor using a second toner in a color different from that of the first toner, an eighth step of transferring a second toner image formed on the photoreceptor to the specified region of the copy sheet which holds the first toner image.

According to the image forming method in accordance with the present invention, the image of an original document is reproduced on a copy sheet during the first image forming process comprising the first through fourth steps, and thereafter, a half-tone image is superimposed on the specified region of the copy sheet subjected to the first image forming process during the second image forming process comprising the fifth through eighth steps.

Accordingly, for example, when a copy sheet is white, a black toner is used in the first image forming process, and a white toner is used in the second image forming process, a white half-tone solid of the white toner is superimposed on the black toner image. As a result, the black toner image formed on the specified region looks soft half-tone.

Using a blue toner in the second image forming process, the black toner image of the specified region looks emphasized by a half-tone solid of the blue toner.

BRIEF DESCRIPTION OF THE DRAWINGS

These and other objects and feature of the present invention will become apparent from the following description in conjunction with the preferred embodiment thereof with reference to the accompanying drawings, in which.

DETAILED DESCRIPTION OF THE INVENTION

Figure 1:
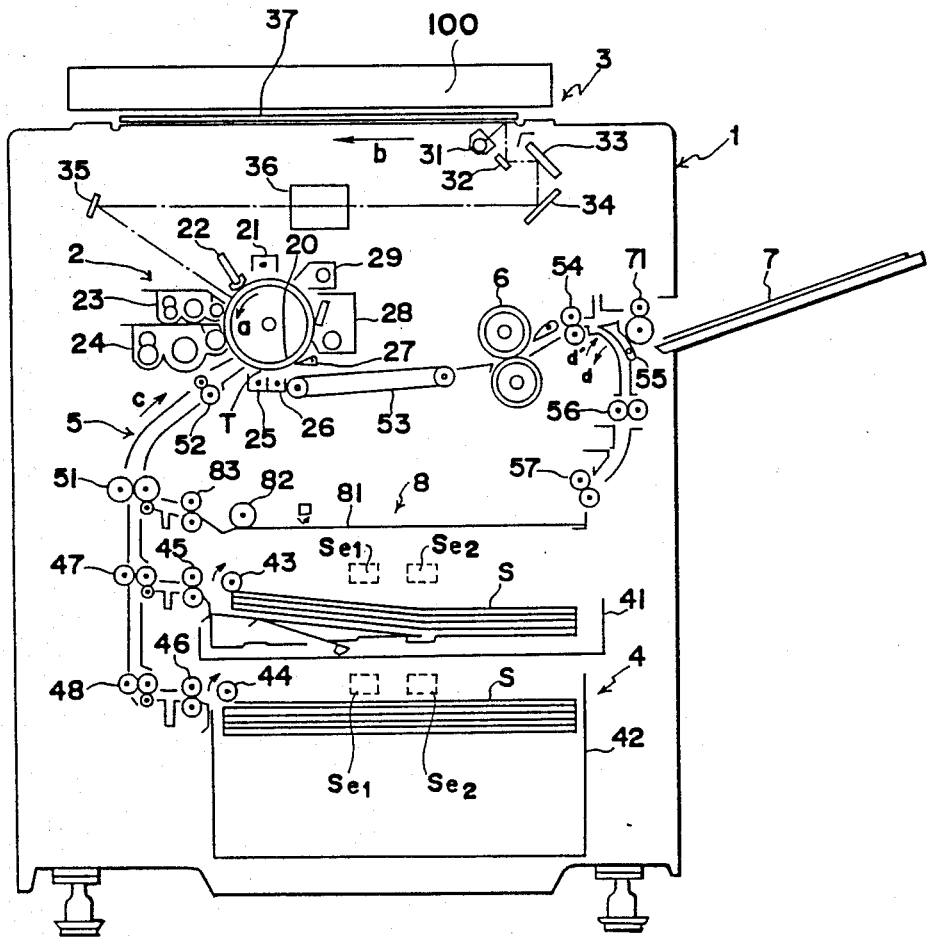
FIG. 1 is a sectional view of a copying machine in accordance with a preferred embodiment of the present invention.

Referring now to the drawings, there is shown in FIG. 1, a copying machine 1 for embodying the image forming method of the present invention. The copying machine 1 essentially comprises an image forming section 2, an image exposing section 3, a sheet supplying section 4, a sheet transporting section 5, a sheet discharging section 7, and a sheet re-supplying section 8.

The constructions of the above described sections are described hereinafter in detail.

(i) Image Forming Section

A photoreceptor drum 20 having a photosensitive layer consisting of $As_2Se_3$ on the surface thereof and rotatable in the direction shown by an arrow (a) is provided in the center of the image forming section 2. There are provided in the pheriphery of the photoreceptor drum 20 a charger 21, an eraser 22, a first developing unit 23, a second developing unit 24, a transfer charger 25, a separation charger 26, a separation claw 27, a cleaning unit 28, and an eraser lamp 29.

Figure 2:
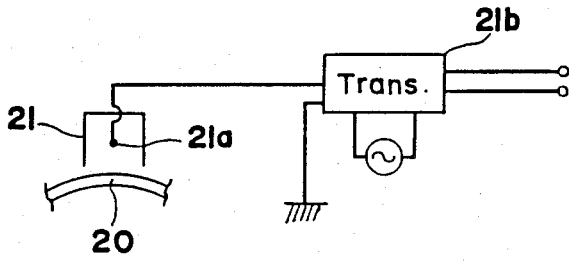
FIG. 2 is a circuit diagram showing the power supply mechanism of a charger.

The charger 21 applies a constant electric charge (a positive charge in this embodiment) to the surface of the photoreceptor drum 20. As shown in FIG. 2, a voltage to be applied to a charge wire 21*a* from a transformer 21*b* is switched by a single outputted from a control unit (not shown).

Figure 3A:
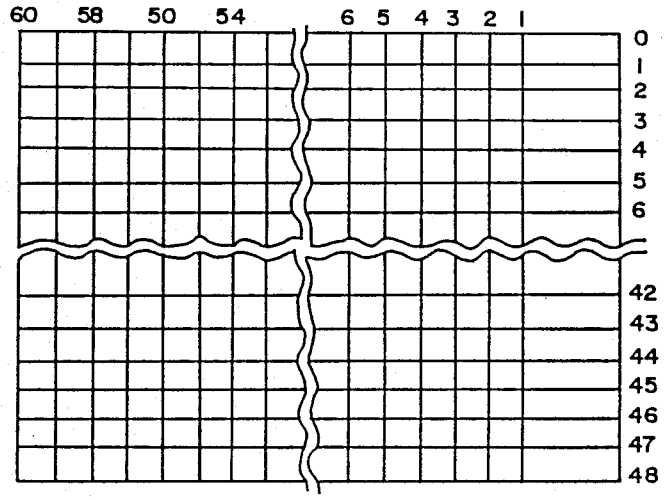
FIG. 3*a* is a plan view showing the divided region of a photoreceptor drum.
Figure 3B:
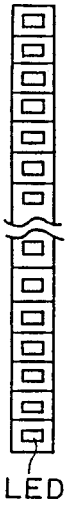
FIG. 3*b* is a front view showing the alignment of light emitting diodes of an eraser.

The eraser 22 irradiates the surface of the photoreceptor drum 20 to erase the electric charge therefrom. As shown in FIG. 3*b*, light emitting diodes included in the eraser 22 and aligned in the axial direction of the photoreceptor drum 20 functions as an image editing unit by flashing some of them and controlling the flash timing. The light emitting diodes irradiate blocks (picture elements) formed on the photoreceptor drum 20 in the rotation direction thereof and the direction perpendicular thereto as shown in FIG. 3*a* showing the unfolded view of the photoreceptor drum 20.

The first developing unit 23 and the second developing unit 24 develop an electrostatic latent image formed on the surface of the photoreceptor drum 20 in the form of a magnetic brush. The first developing unit 23 contains a developer containing a white toner and the second developing unit 24 contains a developer containing a black toner. Either the first developing unit 23 or the second developing unit 24 is used in the normal mode (letter-copying mode) and both are used in turn in the image editing mode which will be described later.

For selectively driving the developing units 23 and 24, some methods can be employed. One method is that the first and second developing units, supported for movement in a direction close towards and away from the photosensitive surface of the drum 20, are selectively driven close towards and away from the photosensitive surface of the drum 20. Another method is that, while magnet rollers disposed inside a developing sleeve are provided for rotation through a predetermined angle, a switching is effected between a developing position, in which the magnetic pole confronts the photosensitive surface of the drum 20, and a non-developing position in which a spacing between magnetic poles confronts the photosensitive surface of the drum 20. A still another method is that the bias voltage applied to the developing sleeve applied during the non-developing position is increased to a value higher than that applied during the developing position. In any event, all of these methods are disclosed in the copending U.S. application Ser. No. 59,850 which is herein incorporated by reference and, therefore, the details thereof will not be reiterated here.

A developer consists of a magnetic carrier and an insulating toner which are charged in opposite polarities when both frictionally contact with each other. In this embodiment, the toner is charged negative which is the opposite polarity to that of the charger.

The transfer charger 25 applies a positive electric charge (corona discharge) to the back surface of a copy sheet (S) transported in the direction shown by an arrow (c) so as to transfer a toner image, formed on the surface of the photoreceptor drum 20 by the first developing unit 23 or the second developing unit 24, to the copy sheet (S).

The sheet separation charger 26 applies an alternating electric charge to the back surface of the copy sheet (S) on which the toner image has been transferred so that the sheet separation charger 26 separates the copy sheet (S) from the surface of the photoreceptor drum 20. At this time, the copy sheet (S) is brought into contact with the sheet separation claw 27, and then, dropped on a transporting belt 53.

The cleaning unit 28 removes a toner which has remained on the surface of the photoreceptor drum 20 after the toner image is transferred to the copy sheet (S).

The eraser lamp 29 irradiates the surface of the photoreceptor drum 20 so as to erase an electric charge which has remained thereon.

(ii) Image Exposing Section

The image exposing section 3 exposes the image of an original document placed on an original document-placing glass 37 to a light. The exposing lamp 31 scans the image of the original document in the direction shown by an arrow (b) by irradiating the image of the original document. The light reflected from the first mirror 32 is incident on the surface of the photoreceptor drum 20 from between the eraser 22 and the first developing unit 23 through a first mirror 32, a second mirror 33, a third mirror 34, a lens 36, and a fourth mirror 35. Thus, an electrostatic latent image is formed on the photoreceptor drum 20.

(iii) Sheet Supplying Section

The sheet supplying section 4 is disposed in the lower portion of the copying machine 1. A white copy sheet (S) in sheet supplying trays 41 is transported to the sheet transporting section 5 through rollers 43, 45, 47 and a white copy sheet (S) in the sheet supplying tray 42 is transported to the sheet transporting section 5 through rollers 44, 46, 48, and 47.

(iv) Sheet Transporting Section

In the sheet transporting section 5, the copy sheet (S) transported from the sheet supplying section 4 is transported to the transfer region (T) at which a timing roller 52 confronts the photoreceptor drum 20, and then, transported to a fixing unit 6 through a transporting belt 53. Thereafter, it is transported to the sheet discharging section 7 through a roller 54 on the sheet re-supplying section 8 through rollers 54, 56, and 57.

A selection claw 55 is moved either to the direction shown by an arrow (d) or an arrow (d'). In the normal copying mode, i.e., when the image of an original document is transferred to the copy sheet (S) one time, the copy sheet (S) is discharged to the sheet discharging section 7 through the discharging roller 71. In a composite-copying mode, i.e., when the image of the original document is transferred to the copy sheet (S) two times or more, the copy sheet (S) is transported downwards to the sheet re-supplying section 8 through rollers 56 and 57 after the first image forming process is completed. When the second image forming process has been completed, the copy sheet (S) is discharged to the sheet discharging section 7.

(v) Sheet Re-supplying Section

In the sheet re-supplying section 8, the copy sheet (S) transported through the sheet transporting section 6 is placed on a sheet re-supplying tray 81. Thereafter, the copy sheet (S) is re-supplied to the sheet transporting section 5 through a re-supplying roller 82 and a transporting roller 83.

The operation of the photograph-copying mode in which part of the image of the original document is reproduced as a half-tone image by the copying machine 1 having the above-described construction is described hereinbelow.

(i) Region Specification

A region which is to be reproduced as a half tone image is specified before a copying operation starts.

Figure 4:
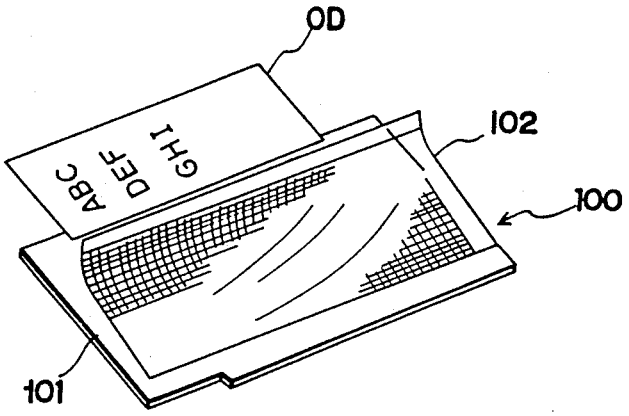
FIG. 4 is a perspective view of an image editing unit.
Figure 5:
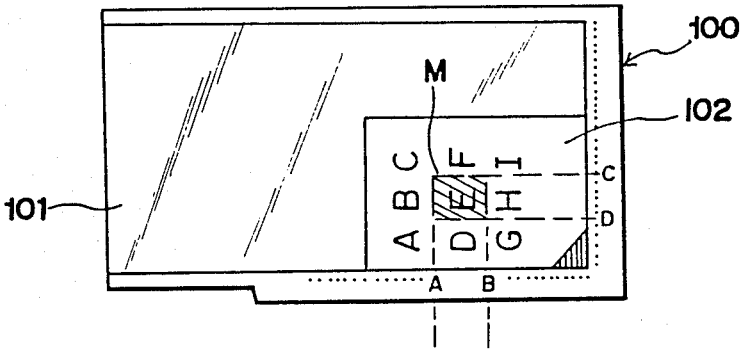
FIG. 5 is a plan view of the image editing unit.
Figure 6:
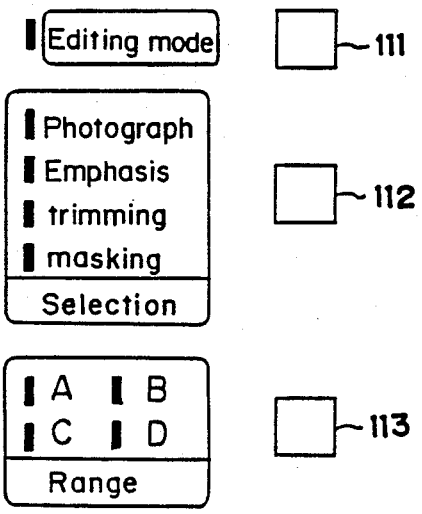
FIGS. 6 and 7 are plan views showing the operation panel.
Figure 7:
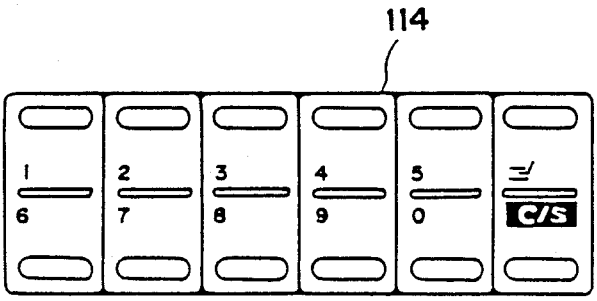

The region is specified by an image editing unit 100 (refer to FIGS. 4 and 5) provided over the original document-placing glass 37 and keys (refer to FIGS. 6 and 7) provided on an operation panel. The image editing unit 100 comprises an original document-placing plate 101 and an image editing map 102. As shown in FIG. 5, the original document-placing plate 101 is graduated longitudinally and transversely in the vicinity of the edges of one side of the original document-placing plate. The image editing map 102 is a transparent sheet having a mesh pattern which corresponds to the blocks formed on the photoreceptor drum 20 shown in FIG. 3*a* and mounted openably on one side of the original document-placing plate 101.

The original document is sandwiched between the original document-placing plate 101 and the image editing map (102) with the top surface of the original document upward. Thus, the coordinate values (A), (B), (C), and (D) corresponding to the specified region (M) are read by an operator.

Thereafter, an editing mode-selection button 111 (shown in FIG. 6) on the operation panel is pressed so as to select an image editing mode, and then, a selection button 112 is pressed to select a photograph-copying mode. Thereafter, a range setting button 113 is pressed in turn so that the coordinate values (A)~(D) are inputted to the control unit by using numerical keys 114.

Thus, an operation for performing a copying operation is completed. Thereafter, a print switch is turned on to start the first and second image forming processes with the original document placed on the original document-placing glass 37.

(ii) First Image Forming Process

In the first image forming process, first, the transformer 21*b* of the charger 21 is set at a high voltage (6.5 KV). As a result, the first developing unit 23 is not driven, the second developing unit 24 is driven, and the selection claw 55 is moved in the direction shown by the arrow (d').

Figure 9:
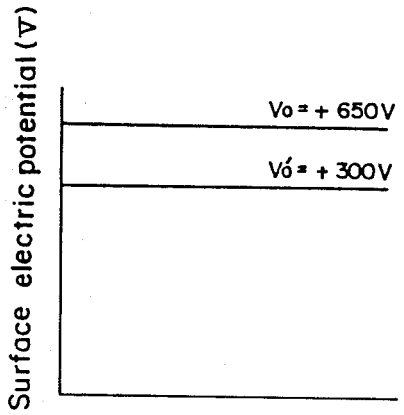
FIGS. 9 and 10 are views showing electric potential distribution on the photoreceptor drum.

In this state, the photoreceptor drum 20 rotates in the direction shown by the arrow (a) and the surface of the photoreceptor drum 20 is uniformly charged (+650 V) by the charger 21 (refer to FIG. 9). The eraser 22 erases the electric charge from the photoreceptor drum 20 except the region corresponding to the area of the original document.

In the image exposing section 3, the exposing lamp 31 scans the image of the original document in the direction shown by the arrow (b) in FIG. 1. The light reflected from the image of the original document is incident on the surface of the photoreceptor drum 20 to form an electrostatic latent image corresponding to the image of the original document thereon. The electric potential of the electrostatic latent image is approximately +650 V and the electrostatic potential of the surface of the photoreceptor drum 20 is reduced to approximately 0 V except the region on which the electrostatic latent image has been formed.

Figure 11:
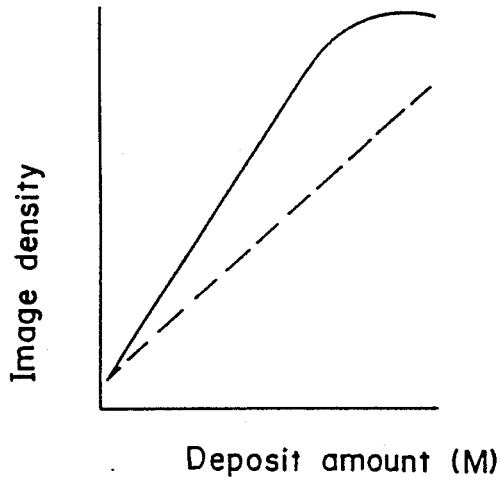
FIG. 11 is a view showing the relationship between the amount of a toner deposit amount and an image density.

A black toner is supplied from the second developing unit 24 to the electrostatic latent image at the portion at which the electrostatic latent image confronts the second developing unit 24. Thus, a black toner image is formed. As shown by a solid line in FIG. 11, the image density is proportional to the amount of the black toner which has deposited on the electrostatic latent image until a certain point. The image density does not increase beyond the point. Therefore, the tone of the toner image is to be obtained thereafter is hard.

A white toner is not supplied to the surface of the photoreceptor drum 20 because the first developing unit 23 is not driven in the first image forming process.

The copy sheet (S) is transported either from the sheet housing tray 41 or 42 of the sheet supplying section 4 to the portion in front of the timing roller 52 of the sheet supplying section 5. Thereafter, the copy sheet (S) is transported to a transfer region (T) in synchronism with the front edge of the electrostatic latent image. At the transfer region (T), the black toner is transferred to the copy sheet (S) by the corona discharge of the charger 25.

The copy sheet (S) to which the black toner has been transferred is separated from the surface of the photoreceptor drum 20 by the separation charger 26 and the separation claw 27, and thereafter, transported to the fixing unit 6 by the transporting belt 53. The fixing unit 6 melts the black toner and fixes it to the copy sheet (S). Thereafter, the copy sheet (S) is transported to the sheet re-supplying tray 81 through rollers 54, 56, and 57.

The photoreceptor drum 20 continues rotating in the direction shown by the arrow (a) until the cleaning unit 28 removes the toner which have remained on the photoreceptor drum 20 and the eraser lamp 29 erases the electric charge on the photoreceptor drum 20. Thus, the copying machine 1 prepares for the second image forming process to be performed subsequently.

(iii) Second Image Forming Process

In the second image forming process, the transformer 21*b* of the charger 21 is set at a low voltage (5.7 KV). As a result, the first developing unit 23 is driven, the second developing unit 24 is not driven, the position of the selection claw 55 is moved in the direction shown by the arrow (d), and the image exposing lamp 31 is not driven.

When the second image forming process starts in this state, the surface of the photoreceptor drum 20 is uniformly charged by the charger 21 at a voltage of +300 V which is lower than that applied thereto in the first image forming process (refer to FIG. 9.)

Figure 8:
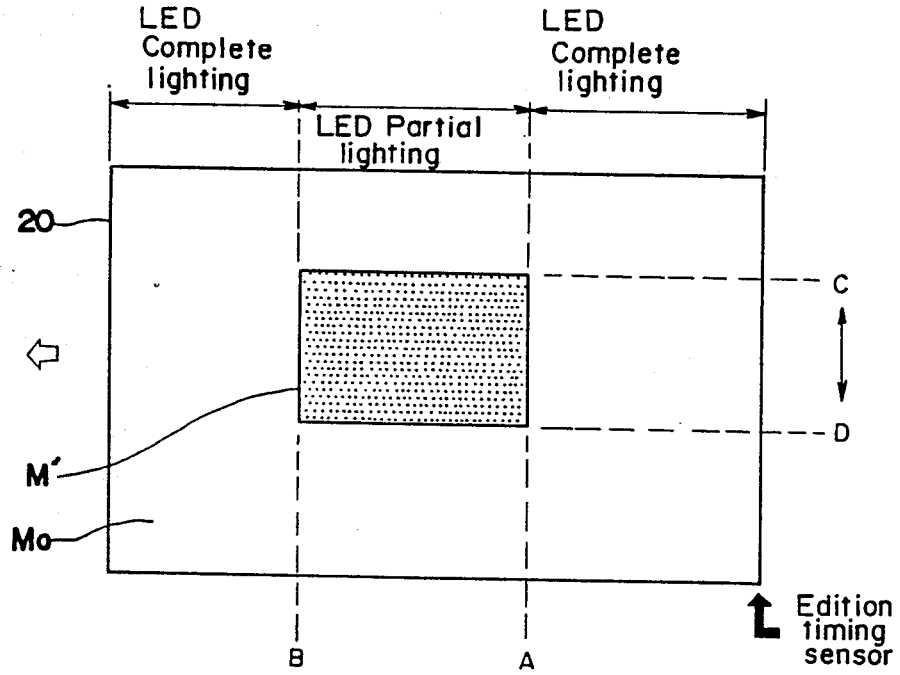
FIG. 8 is an unfolded view of the photoreceptor drum.
Figure 10:
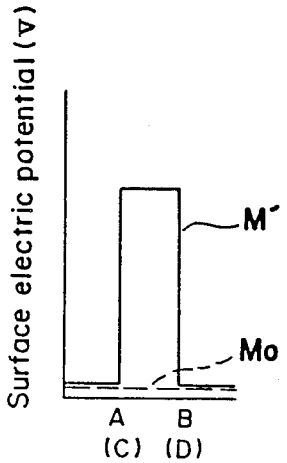

Some of the light emitting diodes of the eraser 22 are flashed in response to a signal which the control unit outputs according to the data, of the specified region (M), inputted from the numerical keys on the operation panel. As shown in FIGS. 8 and 10 showing the unfolded view of the photoreceptor drum 20 and the electric potential on the surface of the photoreceptor drum 20, respectively, the electric charge of a region (MO) is erased except a region (M') corresponding to the specified region (M). The time when the light emitting diodes are turned on and turned off are controlled according to the signal transmitted from an image editing timing sensor (not shown). The exposing lamp 31 of the image exposing section 3 is turned off so that the image of the original document is not irradiated in the second image forming process.

Followed by the above-described operation, a white toner is supplied from the first developing unit 23 to the region (M') to form a solid of the white toner.

The electric potential of the photoreceptor drum 20 in second image forming process is lower than that in the first image forming process. Accordingly, the amount of the white toner which deposits on the electrostatic latent image per area in the second image forming process is less than that in the first image forming process. As a result, the solid of the white toner thus formed is half-tone.

The copy sheet (S) stored the re-supplying tray 81 is transported to the transfer region (T) through the sheet supplying section 5 in response to a signal transmitted from the image editing timing sensor (not shown). Thus, the solid of the white toner is transferred to the region, of the copy sheet (S), corresponding to the specified region (M) of the original document.

The copy sheet (S) is separated from the photoreceptor drum 20 by the separation charger 26 and the separation claw 27. Thereafter, the copy sheet (S) is transported to the fixing unit 6, through the transporting belt 53, where the solid of the white toner is melted and fixed to the copy sheet (S), and then, discharged to the sheet discharging section 7 through rollers 54 and 71.

Since only the black toner has deposited on the copy sheet (S) except the specified region (M) in which the solid of the white toner has been superimposed on the black toner, the image quality in the region except for the region (M) has image quality which is sharp and clear although the tone of the toner image is not preferable. Contrary to this, the image density distribution of the region (M) is as shown by a dotted line in FIG. 11 because the white half-tone solid of the white toner is thinly formed on the black toner image. Therefore, the tone of the image of the region (M) is preferable.

The examination of the reproduced tone of the half-tone image based on Kodak Grey Scale Standard indicates that the tone obtained according to the present invention is nine levels as against six levels conventionally obtained.

If the first developing unit 23 or the second developing unit 24 does not contain a toner whose color is the same as that of the copy sheet (S), the indicator for indicating that a developing unit containing a toner in the same color as that of the copy sheet (S) is to be set in the copying machine 1 may be provided on the copying machine 1 so that a copying operation is not performed.

In the above-described photograph copying mode, the half-tone solid of the white toner is superimposed on the specified region, of the white copy sheet (S), where the black toner image has been formed so that the black toner image of the specified region is reproduced as a half-tone image. However, a black toner image can be also emphasized by using a copy sheet in a color different from the colors of toners or using a toner in a color other than white but not in black and superimposing a half-tone solid in the color of the toner on the black toner image.

When a color copy sheet is used, the color of the copy sheet (S) stored in the sheet supplying section 5 can be detected by the outputs of sensors Se1 and Se2 (refer to FIG. 1) composed of the combination of the color light emitting diode and a phototransistor with reference to table 1.

TABLE 1

| | Sensor Se1 (red LED + phototransistor) | Sensor Se2 (blue LED phototransistor) | color of copy sheet |
|---|---|---|---|
| 1 | H | L | red |
| 2 | H | H | white |
| 3 | M | L | brown |
| 4 | L | H | blue |
| 5 | L | L | Black & others |

H: output of transistor is High
M: output of transistor is Middle
L: output of transistor is Low The color of the toner housed in the developing units 23 and 24 can be detected by indicators which indicates which of the connector pins mounted on the developing units 23 and 24 is connected to which of the connector mounted on the copying machine.

In the above-described embodiment, a half-tone solid is formed by applying a lower voltage to the charger 21 through the transformer 21*b* in the second image forming process so that the white toner is supplied to the photoreceptor drum 20 in an amount smaller than that supplied thereto in the first image forming process. However, the following other means may be used to form a half-tone solid.

Figure 12:
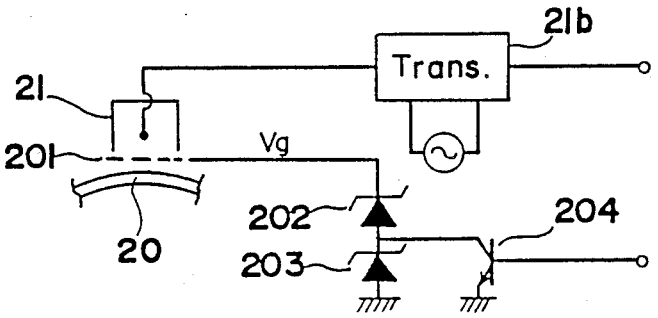
FIG. 12 is a circuit diagram showing another embodiment of the charger.

A first means is as follows: As shown in FIG. 12, a Scorotron charger is used as the charger 21 and a grid 201 is grounded through varisters 202 and 203, and a transistor 204 is connected to a wire connecting the varisters 202 and 203. In the second image forming process, the transistor 204 is actuated in response to a signal transmitted from the control unit (not shown) so as to ground the wire connecting the varisters 202 and 203. Thus, the bias voltage (Vg) to be applied to the grid 201 is reduced from +800 V to +350 V, whereby the photoreceptor drum 20 is charged at a low voltage.

Figure 13:
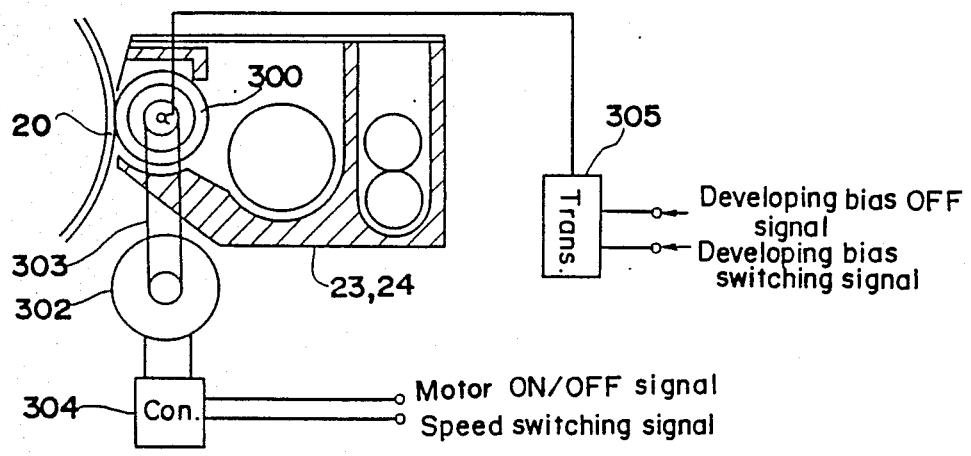
FIG. 13 is a view showing a schematic construction of the developing unit.

A second means is as follows: As shown in FIG. 13, the output of a developing bias transformer 305 is switched in response to a developing bias switching signal. According to this means, the bias voltage (Vb) of 100 V is applied to a developing sleeve 300 in a normal copying mode and 350 V in a half-tone image forming mode.

A third means is as follows: Based on a speed switching signal, the rotation speed of the developing sleeve motor 302 of the developing units 23 and 24 is controlled by a data speed controller 304. According to this means, the rotation speed of the developing sleeve 302 is twice as fast as that of the photoreceptor drum 20 in the normal copying mode and is 1.2 as fast in the half-tone image forming mode.

In the above-described embodiment, a specified region of a copy sheet, for example, the image of a photograph is formed as a half tone image by the first and second image forming processes. In addition, it is possible to erase an image formed on the copy sheet by the first image forming process by appropriately selecting the color and the amount of a toner of a second toner.

The method for erasing part of an image formed on a copy sheet by an electrophotographic copying process is described hereinbelow.

The construction of a copying machine to be used in the following embodiment is substantially the same as that shown in FIG. 1, but a little different in operation.

(i) Region Specification

A region which is to be reproduced as a half tone image is specified before a copying operation starts.

The region is specified by an image editing unit 100 (refer to FIGS. 4 and 5) provided over the original document-placing glass 37 and keys (refer to FIGS. 6 and 7) provided on an operation panel.

The original document is sandwiched between the original document-placing plate 101 and the image editing map (102) with the top surface of the original document upward. Thus, the coordinate values (A), (B), (C), and (D) corresponding to the specified region (M) are read by an operator.

Thereafter, an editing mode-selection button 111 (shown in FIG. 6) on the operation panel is pressed so as to select an image editing mode, and then, a selection button 112 is pressed to select a masking mode. Thereafter, a range setting button 113 is pressed in turn so that the coordinate values (A)~(D) are inputted to the control unit by using the numerical keys 114.

Thus, an operation for performing a copying operation is completed. Thereafter, a print switch is turned on to start the first and second image forming processes with the original document placed on the original document-placing glass 37.

(ii) First Image Forming Process

In the first image forming process, first, the transformer 21*b* of the charer 21 is set at a relatively low voltage (6.5 KV). As a result, the first developing unit 23 is not driven, the second developing unit 24 is driven, and the selection claw 55 is moved in the direction shown by the arrow (d').

In this image forming process, the photoreceptor drum 20 rotates in the direction shown by the arrow (a) and the surface of the photoreceptor drum 20 is uniformly charged (+650) by the charger 21. The eraser 22 erases the electric charge from the photoreceptor drum 20 except the region corresponding to the area of the original document.

In the image exposing section 3, the exposing lamp 31 scans the image of the original document in the direction shown by the arrow (b) in FIG. 1. The light reflected from the image of the original document is incident on the surface of the photoreceptor drum 20 to form an electrostatic latent image corresponding to the image of the original document thereon. The electric potential of the electrostatic latent image is approximately +650 V and the electric potential of the surface of hte photoreceptor drum 20 is reduced to approximately 0 V except the region on which the electrostatic latent image has been formed.

A black toner is supplied from the second developing unit 24 to the electrostatic latent image at the portion at which the electrostatic latent image confronts the second developing unit 24.

A white toner is not supplied to the surface of the photoreceptor drum 20 because the first developing unit 23 is not driven in the first image forming process.

The copy sheet (S) is transported either from the sheet housing tray 41 or 42 of the sheet supplying section 4 to the portion in front of the timing roller 52 of the sheet supplying section 5. Thereafter, the copy sheet (S) is transported to a transfer region (T) in synchronism with the front edge of the electrostatic latent image. At the transfer region (T), the black toner is transferred to the copy sheet (S) by the corona discharge of the charger 25.

The copy sheet (S) to which the black toner has been transferred is separated from the surface of the photoreceptor drum 20 by the separation charger 26 and the separation claw 27, and thereafter, transported to the fixing unit 6 by the transporting belt 53. The fixing unit 6 melts the black toner and fixes it to the copy sheet (S). Thereafter, the copy sheet (S) is transported to the sheet re-supplying tray 81 through rollers 54, 56, and 57.

The photoreceptor drum 20 continues rotating in the direction shown by the arrow (a) until the cleaning unit 28 removes the toner which have remained on the photoreceptor drum 20 and the eraser lamp 29 erases the electric charge on the photoreceptor drum 20. Thus, the copying machine 1 prepares for the second image forming process to be performed subsequently.

(iii) Second Image Forming Process

In the second image forming process, the transformer 21*b* of the charger 21 is set at a high voltage (8.0 KV). As a result, the first developing unit 23 is driven, the second developing unit 24 is not driven, the position of the selection claw 55 is moved in the direction shown by the arrow (d), and the image exposing lamp 31 is not driven.

When the second image forming process starts in this state, the surface of the photoreceptor drum 20 is uniformly charged by the charger 21 at a voltage of +800 V which is higher than that applied thereto in the first image forming process.

Some of the light emitting diodes of the eraser 22 are flashed in response to a signal which the control unit outputs according to the data, of the specified region (M), inputted from the numerical keys on the operation panel. As shown in FIGS. 8 and 10 showing the unfolded view of the photoreceptor drum 20 and the electric potential on the surface of the photoreceptor drum 20, respectively, the electric charge of a region (MO) is erased except a region (M') corresponding to the specified region (M). The time when the light emitting diodes are turned on an turned off are controlled according to the signal transmitted from an image editing timing sensor (not shown). The exposing lamp 31 of the image exposing section 3 is turned off so that the image of the original document is not irradiated in the second image forming process.

Followed by the above-described operation, a white toner is supplied from the first developing unit 23 to the region (M') to form a solid of the white toner.

The copy sheet (S) stored in the re-supplying tray 81 is transported to the transfer region (T) through the sheet supplying section 5 in response to a signal transmitted from the image editing timing sensor (not shown). Thus, the solid of the white toner is transferred to the region, of the copy sheet (S), corresponding to the specified region (M) of the original document.

The copy sheet (S) is separated from the photoreceptor drum 20 by the separation charger 26 and the separation claw 27. Thereafter, the copy sheet (S) is transported to the fixing unit 6, through the transporting belt 53, where the solid of the white toner is melted and fixed to the copy sheet (S), and then, discharged to the sheet discharging section 7 through rollers 54 and 71.

Only the black toner deposits on the copy sheet (S) except the specified region (M) whereas the solid of the white toner is superimposed on the black toner image in the region (M). Therefore, the black toner image in the region (M) looks as though it is erased.

In the above-described embodiment, the first image forming process of reproducing the image of the original document on the copy sheet is performed, and thereafter, the second image forming process of superimposing the white solid on the specified region of the copy sheet is effected. However, the image on an original document itself supplied from the sheet supplying section 4 may be corrected by performing the second image forming process only. By doing so, if the image of an original document has various colors and is very detailed, part of the image of the original document can be corrected without erasing the image of the original document.

In the above-described embodiment, the solid of the white toner is superimposed on the black toner image formed on the white copy sheet (S), but part of the image of the original document may be erased by using a copy sheet (S) in a color other than white and a toner in the same color as that of the copy sheet (S).

In the above-described embodiment, the force for fixing the solid of a white toner to be superimposed on the black toner image is the same as that for fixing the black toner to be fixed to the copy sheet (S), but the force for fixing the white toner to the copy sheet (S) is reduced as compared with that for fixing the black toner to the copy sheet (S), whereby the solid of the white toner image can be easily rubbed off from the copy sheet (S). This method is advantageous in that the black toner image covered with the white toner may appear again.

Figure 14:
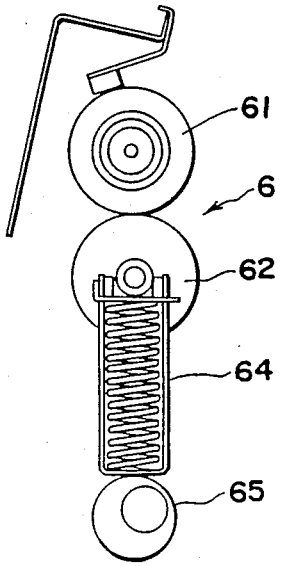
FIG. 14 is a sectional view of a fixing unit.
Figure 15:
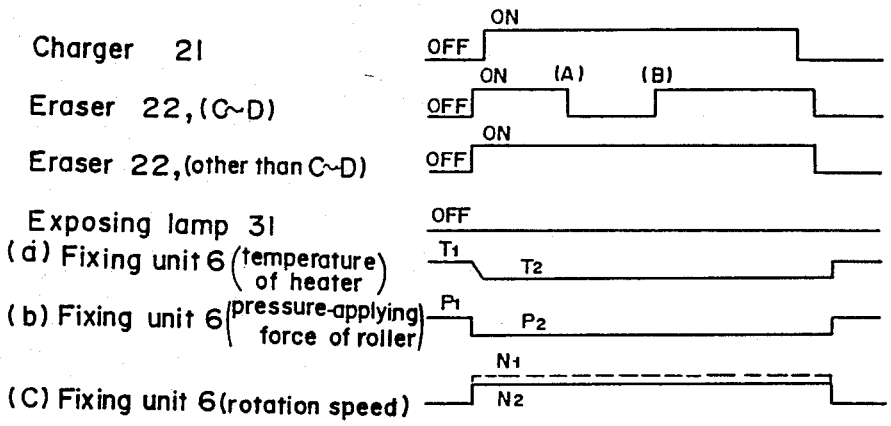
FIG. 15 is a timing chart showing another operation method of the fixing unit and other members.

In order to perform this method, the fixing unit 6 (refer to FIG. 14) is set in one of the following three conditions (a), (b) and (c) as shown in FIG. 15 indicating the operations of the charger 21, the eraser 22, and the exposing lamp 31.

(a) The temperature of the heater mounted on the upper fixing roller 61 is set to be lower ($T_2=160°$ C.) than the temperature ($T_1=180°$ C.) suitable for a normal fixing, whereby the surface of the solid of the white toner is melted, but the surface in contact with the copy sheet (S) and the black toner image is not completely melted.

(b) The force ($P_2$) to be applied between the upper roller 61 and the lower fixing roller 62 is reduced as compared with the force suitable for a normal fixing ($P_1=20$ kg/cm) by a pressure-applying member 64 and an eccentric roller 65.

(c) The rotation speeds of the upper fixing roller 61 and the lower fixing roller 62 are increased from $N_2$ to $N_1$.

An example of components of a black toner and a white toner is shown in Table 2. A white toner having the following components peels off more easily than a black toner having the following components.

As an example, both the black toner and the white toner have the same kind of resin. In this case, the control of the amount of a pigment allows the white toner to peel off more easily than the black toner.

TABLE 2

| | | component | black toner | white tone |
|---|---|---|---|---|
| 1 | resin | styrene-acryl | 100 wt % | 100 wt % |
| 2 | charge control agent (for black) | nigrosine base | 5 | — |
| 3 | charge control agent (for white) | styrene-aminoacryl | — | 6 |

TABLE 2-continued

| | | component | black toner | white tone |
|---|---|---|---|---|
| 4 | charge control agent (for white) | quaterary ammonium salt | — | 2 |
| 5 | off-set inhibitor | low molecula-polypropylene | 2.5 | 2.5 |
| 6 | colorant (for black) | carbon black | 3.5 | — |
| 7 | colorant (for white) | titanium oxide | — | 30 |
| 8 | additive (for black) | copper oxide | 7 | — |
| 9 | additive (for black) | silica | 0.1 | — |

The components of the carrier to be mixed with the toners are as follows:

polyester resin, 100 wt %
magnetic powder, 500 wt %
carbon black, 2.0 wt %
silica, 1.5 wt %

The black toner and white toner are fixed to each other at 190° C.

Figure 16:
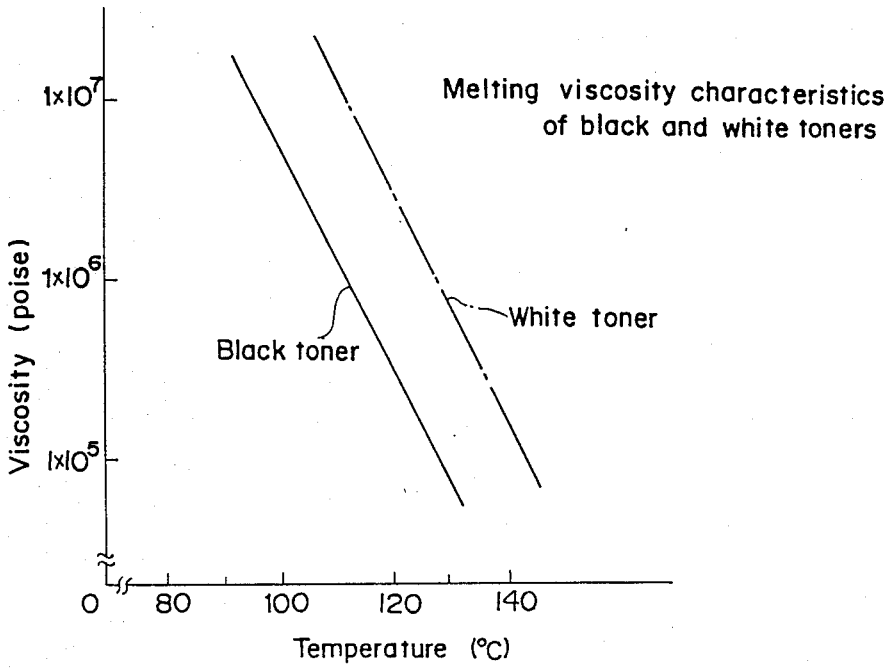
FIG. 16 is a graph showing the melting viscosity characteristics of black toner and white toners.

The black toner and the white toner have the viscosity characteristics as shown in FIG. 16. As apparent from FIG. 16, the viscosity of the white toner is greater than that of the black toner by approximately one order at the same temperature. Accordingly, a white toner image superimposed on a black toner easily peels off the black toner because the white toner having the component shown in Table 2 has a weak fixing strength.

A black toner and a white toner are formed by using different kinds of resins. For example, polyester resin is contained in the black toner and styrene-acryl resin is contained in the white toner. When the white toner is superimposed on the black toner by heated rollers, the image surface of the toner (black toner) containing polyester resin acts as a mirror. Therefore, it is difficult for the white toner which has stuck to the surface of the black toner to penetrate into the black toner, i.e., the white toner peels off the black toner.

The lightness of a white toner is higher than that of a black toner. Therefore, when the white toner is superimposed on the black toner with the amount of the white toner per area being the same as that of the black toner, the black toner image is seen through the white toner image. In order to prevent such an occurrence, experiments were conducted by the present inventors. The experiments indicate that the black toner image cannot be seen through the white toner image when $0.8\sim1.5$ mg/cm$^2$ of the white toner is superimposed on $0.6\sim0.8$ mg/cm$^2$ of the black toner.

In order to achieve the experimental result, one of the following methods is adopted in performing the second image forming process using a white toner as compared with the first image forming process:

(d) The photoreceptor drum 20 is charged by the charger 21 at a higher voltage.

(e) The gap between the first developing sleeve 23*a* and the photoreceptor drum 20 is smaller than that between the second developing sleeve 24*a* and the photoreceptor drum 20.

(f) The magnetic brush formed on the surface of the first developing sleeve 23*a* is higher than that formed on the second developing sleeve 24*a*.

(g) The rotation speed of the first developing sleeve 23*a* is faster than that of the second developing sleeve 24*a*.

As apparent from the foregoing description, in the image editing method in accordance with this embodiment, the surface of the electrostatic latent image-holding member to which electric charge has been uniformly applied is irradiated so as to erase the electric charge except a specified region, and thereafter, a toner is supplied to the specified region where electric charge exists. As a result, a solid is formed on the specified region. Thereafter, the solid is transferred to a copy sheet in the same color as that of the solid.

Thus, the image of an original document can be corrected. Therefore, even though the image of the original document is multi-colored and very detailed, a desired portion can be erased without erasing the color and the image of the original document.

What is claimed is:

1. A method for forming an image by an electrographic system comprising:

a first step of charging a photoreceptor;

a second step of exposing the surface of the charged photoreceptor to a light reflected from the image of an original document so as to form an electrostatic latent image on said photoreceptor;

a third step of developing said electrostatic latent image formed on said photoreceptor using a first toner;

a fourth step of transferring said first toner image formed on said photoreceptor to a copy sheet;

a fifth step of re-charging said photoreceptor;

a sixth step of irradiating said charged photoreceptor so as to erase an electric charge which has remained on a region except the electric charge on a specified region;

a seventh step of developing said specified region on the photoreceptor using a second toner in a color different from that of said first toner; and an eighth step of transferring said second toner image formed on said photoreceptor to said specified region on said copy sheet which holds said first toner image.

2. A method for forming an image by an electrographic system as claimed in claim 1, wherein the color of said second toner is the same as the color of said copy sheet.

3. A method for forming an image by an electrographic system as claimed in claim 2, wehrein the electric potential to be applied in said fifth step is lower than the electric potential to be applied in said first step.

4. A method for forming an image by an electrographic system as claimed in claim 2, wherein the electric potential to be applied in said fifth step is higher than the electric potential applied in said first step.

5. A method for forming an image by an electrographic system as claimed in claim 2, wherein the amount of the toner to be supplied to said photoreceptor in said seventh step is larger than the amount of the toner to be supplied thereto in said third step.

6. A method for forming an image by an electrographic system as claimed in claim 2, wherein the amount of the toner to be supplied to said photoreceptor in said seventh step is smaller than the amount of the toner to be supplied thereto in said third step.

7. A method for forming an image by an electrographic system as claimed in claim 1, wherein the colors of said first and second toners are different from the color of said copy sheet.

8. A method for forming an image by an electrographic system as claimed in claim 7, wherein the electric potential to be applied in said fifth step is lower than the electric potential to be applied in said first step.

9. An image editing method for erasing part of an image formed on a sheet using an image forming apparatus employing an electrophotographic system comprising:

a first step of charging a photoreceptor;

a second step of erasing electric potential of a region other than the electric potential of a specified region by irradiating the surface of said photoreceptor which has been charged;

a third step of developing said specified region of said photoreceptor using a toner whose color is the same as the color of said sheet; and a fourth step of transferring the toner on said photoreceptor to said sheet on which the image has been formed.

* * * * *